US010895027B2

(12) United States Patent
Lonati et al.

(10) Patent No.: US 10,895,027 B2
(45) Date of Patent: Jan. 19, 2021

(54) PICKUP DEVICE FOR PICKING UP A KNITTED TUBULAR MANUFACTURE FROM A CIRCULAR KNITTING MACHINE FOR HOSIERY OR THE LIKE AND FOR TRANSFERRING IT TO A UNIT ADAPTED TO PERFORM ADDITIONAL OPERATIONS ON THE MANUFACTURE

(71) Applicant: Lonati S.P.A., Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 112 days.

(21) Appl. No.: 16/317,187

(22) PCT Filed: Jul. 7, 2017

(86) PCT No.: PCT/EP2017/067079
§ 371 (c)(1),
(2) Date: Jan. 11, 2019

(87) PCT Pub. No.: WO2018/011076
PCT Pub. Date: Jan. 18, 2018

(65) Prior Publication Data

US 2019/0301062 A1 Oct. 3, 2019

(30) Foreign Application Priority Data

Jul. 13, 2016 (IT) ..... 102016000072994

(51) Int. Cl.
*D04B 15/02* (2006.01)
*D04B 9/40* (2006.01)

(52) U.S. Cl.
CPC ..... *D04B 15/02* (2013.01); *D04B 9/40* (2013.01)

(58) Field of Classification Search
CPC ..... D04B 15/02; D04B 9/40
(Continued)

(56) References Cited

U.S. PATENT DOCUMENTS 4,672,824 A * 6/1987 Curry ..... D04B 15/44 66/146
5,487,281 A * 1/1996 Frullini ..... D04B 9/40 66/13

(Continued)

FOREIGN PATENT DOCUMENTS

CN 1106088 A 8/1995
CN 101970739 A 2/2011

(Continued)

OTHER PUBLICATIONS

Search Report from International PCT/EP2017/067079.

(Continued)

*Primary Examiner* — Khoa D Huynh
*Assistant Examiner* — Grace Huang
(74) *Attorney, Agent, or Firm* — Husch Blackwell LLP

(57) ABSTRACT

A pickup device for picking up a knitted tubular manufacture from a circular knitting machine for hosiery or the like and for transferring it to a unit adapted to perform additional operations on the manufacture, comprising an annular pickup body that supports a plurality of pickup elements, which are arranged radially around the axis of the pickup body and can slide with respect to the pickup body along radial directions; the pickup body can be arranged coaxially around the needle cylinder of a circular knitting machine for hosiery or the like, with each one of the pickup elements laterally facing a needle of the machine; actuation means are provided which act on the pickup elements for their movement along the radial directions at least from a first position, (Continued)

in which the pickup elements are closer to the axis of the pickup body, to a second position.

12 Claims, 11 Drawing Sheets

(58) Field of Classification Search
USPC ..... 66/148, 58, 59
See application file for complete search history.

(56) References Cited

U.S. PATENT DOCUMENTS

| | | | | |
|---|---|---|---|---|
| 6,176,106 | B1 * | 1/2001 | Lonati | D04B 15/02 66/95 |
| 7,107,797 | B2 * | 9/2006 | Frullini | D04B 9/02 66/148 |
| 8,028,546 | B2 * | 10/2011 | Lonati | D04B 15/02 66/148 |

FOREIGN PATENT DOCUMENTS

| | | | | |
|---|---|---|---|---|
| CN | 104562409 | A | 4/2015 | |
| CN | 105074071 | A | 11/2015 | |
| EP | 0126035 | B1 | 6/1987 | |
| GB | 1250563 | A * | 10/1971 | D04B 15/34 |
| GB | 1260559 | A * | 1/1972 | D04B 9/56 |
| JP | 2016050370 | A | 4/2016 | |
| WO | PCT2009/112347 | A1 | 9/2009 | |

OTHER PUBLICATIONS

Written Opinion from International PCT/EP2017/067079.
Italian Search Report from IT 201600072994.
China First Office Action of Chinese Application No. 201780043672.2, dated Jan. 3, 2020.
English language translation of Bibliographic Data and Abstract of CN101970739 (A).
English language translation of Bibliographic Data and Abstract of CN104562409 (A).
English language translation of Bibliographic Data and Abstract of CN 105074071 (A).
English language translation of Bibliographic Data and Abstract of CN1106088 (A).
English language translation of Bibliographic Data and Abstract of JP2016050370 (A).
English language translation of Bibliographic Data and Abstract of EP0126035 (A1).

* cited by examiner

PICKUP DEVICE FOR PICKING UP A KNITTED TUBULAR MANUFACTURE FROM A CIRCULAR KNITTING MACHINE FOR HOSIERY OR THE LIKE AND FOR TRANSFERRING IT TO A UNIT ADAPTED TO PERFORM ADDITIONAL OPERATIONS ON THE MANUFACTURE

BACKGROUND OF THE INVENTION

The present invention relates to a pickup device for picking up a knitted tubular manufacture from a circular knitting machine for hosiery or the like and for transferring it to a unit adapted to perform additional operations on the manufacture.

Field of the Invention

In the field of the production of knitted tubular manufactures with circular knitting machines for hosiery or the like, in some cases it is necessary to transfer the manufacture from the machine used to produce the manufacture to another production unit in order to perform further work on the manufacture which cannot be performed on said machine or it is not economically convenient to perform on said machine.

Description of Related Art Including Information Disclosed Under 37 CFR 1.97 and 1.98

In particular, in the field of the production of hosiery, in recent years methods have been developed for the automated execution of the closure of their toe by sewing or looping. Some of these methods are based on picking up the manufacture from the machine used for its production and on its transfer to a station for further work, which is separate from the production machine, so as to close the toe of the hosiery item in the further work station while the machine is used to produce another hosiery item. These methods have the advantage, with respect to other methods based on the execution of the closure of the toe of the hosiery item directly on the machine used for its production, of not penalizing excessively the productivity of the machine.

The transfer of the hosiery item, or more generally of the tubular manufacture, from the machine used for its production to the station in which the closure of an axial end of the manufacture or more generally additional work on the manufacture must be performed, is generally carried out by means of a pickup device which, by means of pickup elements, individually takes the loops of knitting of the manufacture from the needles of the machine and retains them during the transfer of the manufacture.

In some methods for the closure of the toe of hosiery items, the pickup device is used also to support the manufacture during the execution of the further work, while in other methods the pickup device is used exclusively to transfer the manufacture since, once it has reached the station in which the further work is to be performed, it transfers, usually again individually, the loops of knitting previously picked up from by the needles to another device that has the function of supporting the manufacture during the execution of the further work, such as for example a handling device. This handling device arranges the loops that belong to one half of the row of knitting received from the pickup device so that they face the loops of knitting that belong to the other half of the same row of knitting and supports the two partial rows of knitting in a mutually facing position during the intervention of a sewing or looping head which joins the pairs of loops of knitting that face each other.

In pickup devices of the known type used to simply transfer the manufacture from the machine that produces it to a handling device, the coupling between the pickup elements and the needles, in order to transfer the loops of knitting from the needles to the pickup elements, usually occurs by means of the insertion of the head of the needle in a seat that is formed in the end of the pickup element. For this reason, the pickup device usually has an annular pickup body, which is designed to face coaxially the end of the needle cylinder from which the heads of needles protrude and which supports a plurality of pickup elements which are oriented parallel to the axis of the pickup body.

A pickup device of this kind is shown for example in EP 0942086 B1.

In devices of this kind, the coupling between one end of the pickup elements and the head of the corresponding needle requires high precision both in the provision of the pickup device as a whole and in the positioning of the pickup body with respect to the needle cylinder of the machine and of the pickup elements with respect to the needles.

Furthermore, the arrangement of the pickups elements, as well as the presence of any elements for their actuation, entails a relatively large space occupation of the pickup body along a direction that is parallel to its axis. This relatively large space occupation can cause problems in the placement of the pickup body with respect to the machine to pick up the manufacture. In order to be able to arrange the pickup body so that it faces the needle cylinder of the machine, in the case of single-cylinder circular machines it is in fact necessary to lift the dial and the thread guides used to provide the needles with the threads required to produce the manufacture. This lifting can cause a twisting of the threads and consequently cause problems upon resumption of work on the machine.

If the pickup device is used with double-cylinder circular machines, the problems caused by the axial space occupation of the pickup body are even greater, since in this case the pickup body must be positioned between the two needle cylinders by means of the prior lifting of the entire upper needle cylinder and of the elements connected thereto.

In order to solve these problems, a pickup device has been provided and is the subject matter of WO2009/112347 A1, in the name of the same Applicant, which is easy to provide and can be coupled to the needles of the machine with excellent precision. This device, by virtue of its structural simplicity, can have a reduced axial space occupation, making it particularly simple to position it with respect to the machine used to produce the manufacture during the pickup of the manufacture.

The device according to WO2009/112347 A1 comprises an annular pickup body which supports a plurality of pickup elements which are arranged radially around the axis of the pickup body and can slide with respect to the pickup body along radial directions. The pickup body can be coaxially positioned coaxially around the needle cylinder of a circular knitting machine for hosiery and the like so that each one of the pickup elements faces laterally a needle of the machine. The pickup device comprises actuation means which act on the pickup elements in order to cause their movement along the radial directions from a first position, in which the pickup elements are closer to the axis of the pickup body, to a second position, in which the pickup elements are further spaced from the axis of the pickup body with respect to the first position, and vice versa. The end of each one of the pickup elements that is directed toward the axis of the pickup body is hook-shaped and forms a compartment that is adapted to receive at least one loop of knitting.

This device has proved itself susceptible of improvements aimed mainly at increasing safety in the retention of the loops of knitting during their transfer from the machine used for the production of the manufacture to the unit designed to perform further work on the manufacture.

BRIEF SUMMARY OF THE INVENTION

The aim of the present invention is indeed to provide a pickup device for picking up a knitted tubular manufacture from a circular knitting machine for hosiery or the like and for transferring it to a unit adapted to perform additional operations on the manufacture, which has high safety against the accidental disengagement of loops of knitting from the pickup elements.

Within this aim, an object of the present invention is to provide a device that has in any case a high structural simplicity and ensures excellent precision in the coupling of the pickup elements to the needles of the machine used to produce the manufacture.

Another object of the present invention is to provide a pickup device that can have a particularly modest axial space occupation.

A further object of the present invention is to provide a pickup device that can also obviate errors in the radial position of the needles of the machine used to produce the manufacture.

Another object of the present invention is to provide a device that ensures high reliability in operation.

This aim, as well as these and other objects that will become better apparent hereinafter, are achieved by a pickup device for picking up a knitted tubular manufacture from a circular knitting machine for hosiery or the like and for transferring it to a unit adapted to perform additional operations on the manufacture, comprising an annular pickup body that supports a plurality of pickup elements, which are arranged radially around the axis of said pickup body and can slide with respect to said pickup body along radial directions, said pickup body being arrangeable coaxially around the needle cylinder of a circular knitting machine for hosiery or the like, with each one of said pickup elements laterally facing a needle of the machine; actuation means being provided which act on said pickup elements for their movement along said radial directions at least from a first position, in which said pickup elements are closer to the axis of said pickup body, to a second position, in which said pickup elements are spaced further from the axis of said pickup body with respect to said first position, and vice versa; an end of each one of said pickup elements that is directed toward the axis of said pickup body being hook-shaped and forming a compartment that is adapted to receive at least one loop of knitting, characterized in that it comprises safety means which are associated with said pickup body and can be engaged by said end of the pickup elements in their transition from said first position to said second position for the closure of said compartment.

BRIEF DESCRIPTION OF THE SEVERAL VIEWS OF THE DRAWING(S)

Further characteristics and advantages of the invention will become better apparent from the description of a preferred but not exclusive embodiment of the pickup device according to the invention, illustrated by way of nonlimiting example in the accompanying drawings, wherein.

DETAILED DESCRIPTION OF THE INVENTION

Figure 1:
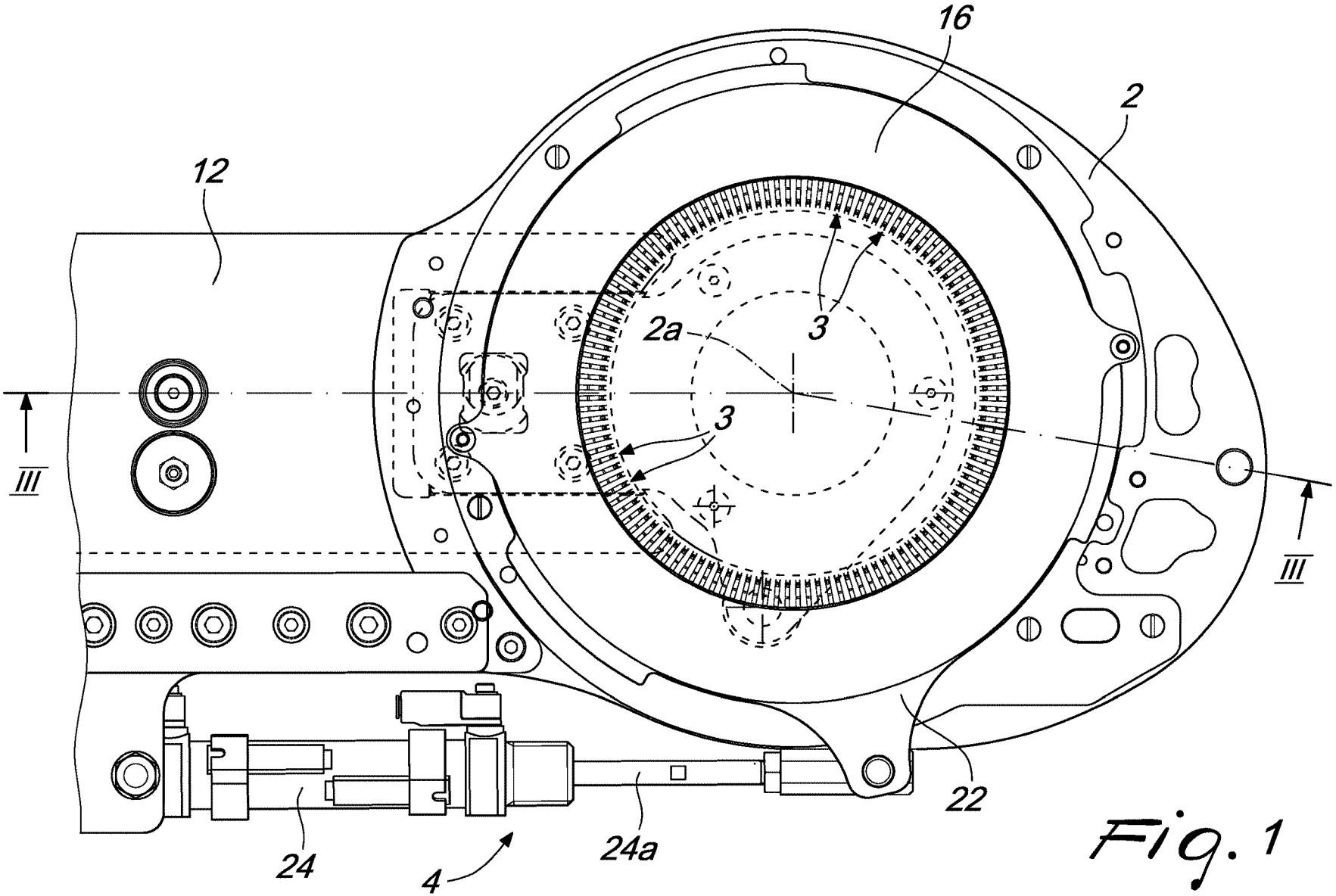
FIG. 1 is a schematic top plan view of a portion of the pickup device according to the invention with the pickup elements in the first position, with some elements omitted for the sake of simplicity and greater clarity.

The device according to the invention is shown in its application to a single-cylinder circular knitting machine for hosiery or the like, generally designated by the reference numeral 41, but it can also be used to pick up a manufacture from the needles arranged in the lower needle cylinder of a circular knitting machine for hosiery or the like of the double-cylinder type or even to pick up a manufacture from the needles arranged in the upper needle cylinder of a double-cylinder circular knitting machine for hosiery or the like. In this last case, however, the device according to the invention must be installed inverted with respect to what is shown in the accompanying figures.

Figure 4:
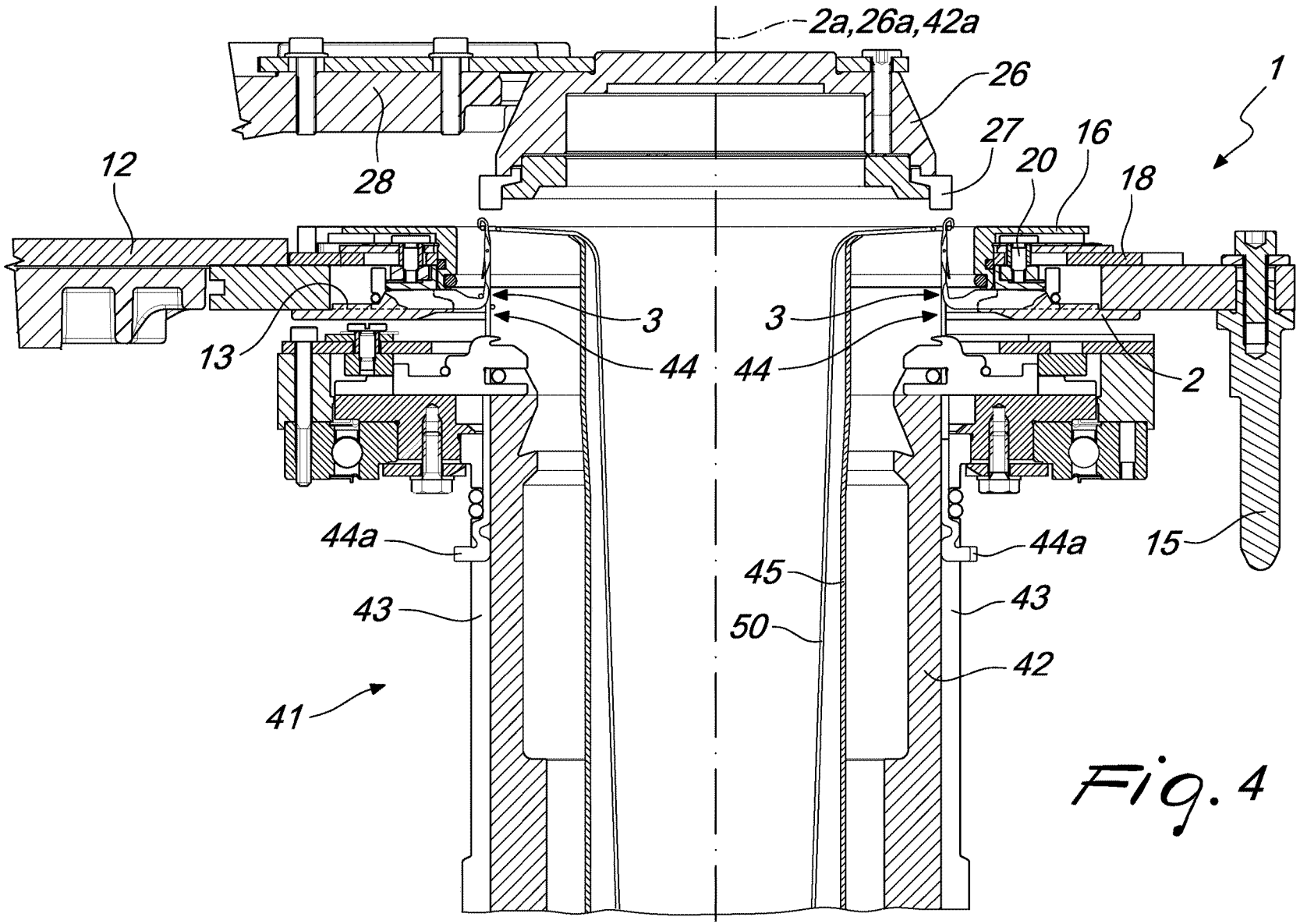
FIG. 4 is a view of the same portion of the pickup device, shown in cross-section in a manner similar to FIG. 3, with the pickup body arranged above and coaxially with respect to the needle cylinder of a circular knitting machine for hosiery or the like and in a lower region with respect to a presser element.
Figure 5:
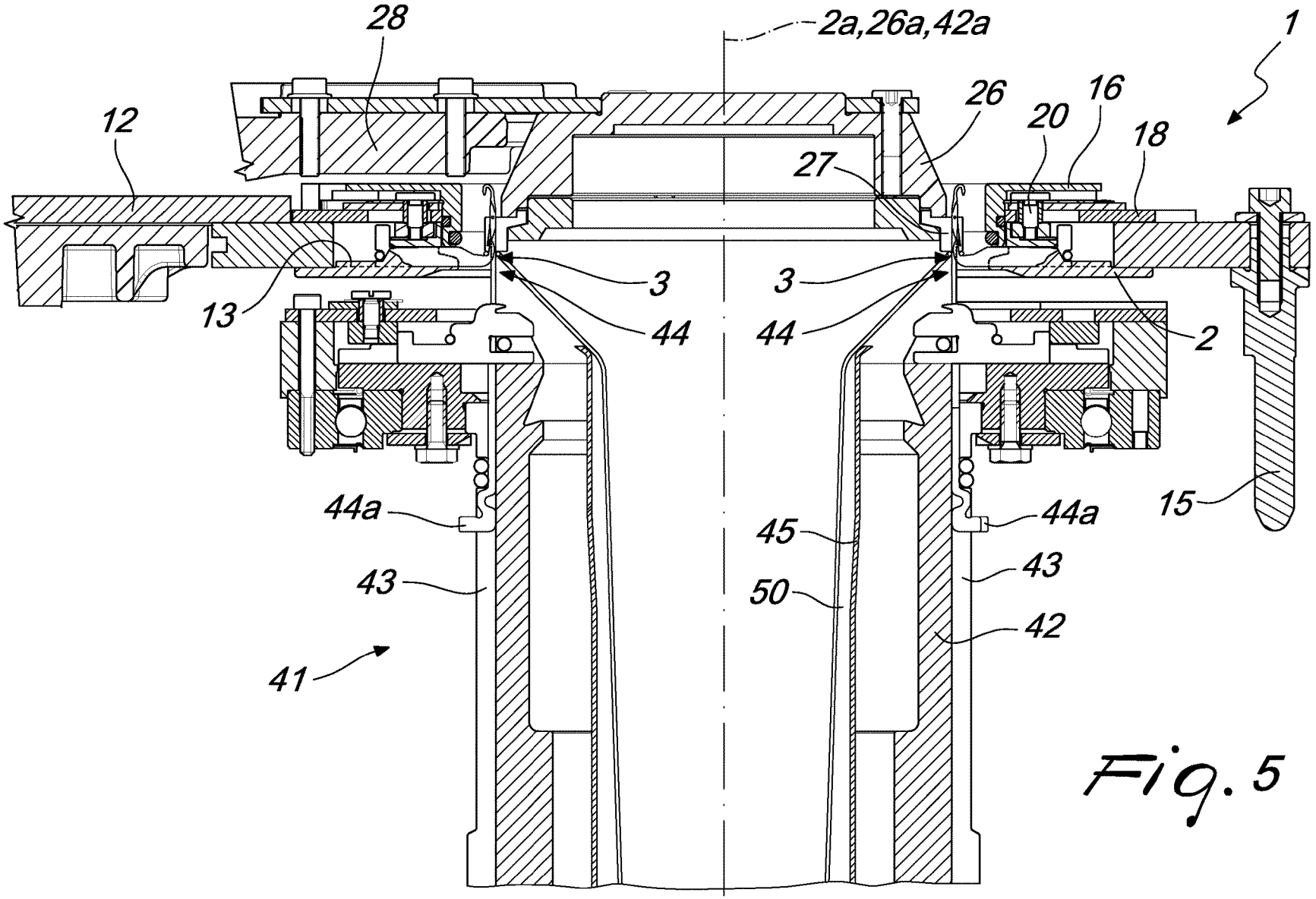
FIG. 5 is a view of the pickup body arranged above and coaxially with respect to the needle cylinder of a circular knitting machine for hosiery or the like, in a manner similar to FIG. 4, during the transition of the loops of knitting from the needles of the machine to the pickup elements.

With reference to FIGS. 4 and 5, the single-cylinder circular hosiery knitting machine 41, designed to be served by the pickup device according to the invention, comprises a needle cylinder 42, with a vertically oriented axis 42*a*. On the lateral surface of the needle cylinder 42 there is a plurality of axial grooves 43 inside each of which a needle 44 is accommodated which can be actuated with an alternating motion along the corresponding axial groove 43 in order to form knitting, in a per se known manner.

Inside the needle cylinder 42 there is, in a per se known manner, a suction tube 45 which is coaxial to the needle cylinder 42. This suction tube 45, the upper end of which is open and is goblet-shaped, can move along the axis 42*a* with respect to the needle cylinder 42 so that it can protrude, for part of its extension, from the upper end of the needle cylinder 42.

The needles 44 are actuated in a per se known manner, for example by means of cams, not shown for the sake of simplicity, which are arranged around the needle cylinder 42 and can be engaged, as a consequence of the rotation of the needle cylinder 42 about its own axis 42*a* with respect to said cams, with the heels 44*a* of the needles 44 that protrude radially from the lateral surface of the needle cylinder 42. The machine 41, being a machine substantially of a known type, is not described further for the sake of simplicity.

With reference to the figures, the pickup device according to the invention, generally designated by the reference numeral 1, comprises an annular pickup body 2, which supports a plurality of pickup elements 3 arranged radially around the axis 2*a* of the pickup body 2. The pickup elements 3 can slide with respect to the pickup body 2 along corresponding radial directions.

The pickup elements 3 are mutually angular spaced around the axis 2*a* of the pickup body 2 so as to correspond to the angular spacing that exists between the needles 44 of the circular knitting machine 41 for hosiery or the like, which must be served by the pickup device 1 so that by arranging the pickup device 1 around the needle cylinder 42 of the machine 41 each pickup element 3 faces laterally, with its end 3*a* directed toward the axis 2*a* of the pickup body 2, a needle 44 of the machine 41.

The pickup device 1 comprises actuation means 4, which act on the pickup elements 3 in order to perform their displacement, along the related radial directions, at least from a first position, in which the pickup elements 3 are closer to the axis 2*a* of the pickup body 2, to a second position, in which the pickup elements 3 are spaced further from the axis 2*a* of the pickup body 2 with respect to the first position, and vice versa, so as to cause the engagement or disengagement of each pickup element 3 with respect to the needle 44 that it is made to face and each one of the pickup elements 3 is adapted to pick the loop of knitting 51 of the manufacture 50 retained by the needle 44, as will become better apparent hereinafter.

The end 3*a* of each one of the pickup elements 3 that is directed toward the axis 2*a* of the pickup body 2 is hook-shaped and forms a compartment 5 that is adapted to receive at least one loop of knitting 51. In the arrangement of the pickup body 2 shown in the figures, this compartment 5, when the pickup elements 3 are in the first position, is open upward.

According to the invention, the pickup device comprises safety means 6 which are associated with the pickup body 2 and can be engaged by the end 3*a* of the pickup elements 3 in their transition from the first position to the second position in order to close the compartment 5.

More particularly, the end 3*a* of each one of the pickup elements 3 that is directed toward the axis 2*a* of the pickup body 2, which is hook-shaped, has its tip oriented substantially parallel to the axis 2*a* of the pickup body 2.

The safety means 6 comprise a circumferential abutment 7 which is extended around the axis 2*a* of the pickup body 2 and the pickup elements 3, in the second position, engage, by means of their tip, against the circumferential abutment 7.

Conveniently, this circumferential abutment 7 is formed by a ring 8 which is accommodated in a circumferential seat 9 that is formed coaxially on the inner lateral surface of the pickup body 2 and is open toward the axis 2*a* of the pickup body 2.

Figure 2:
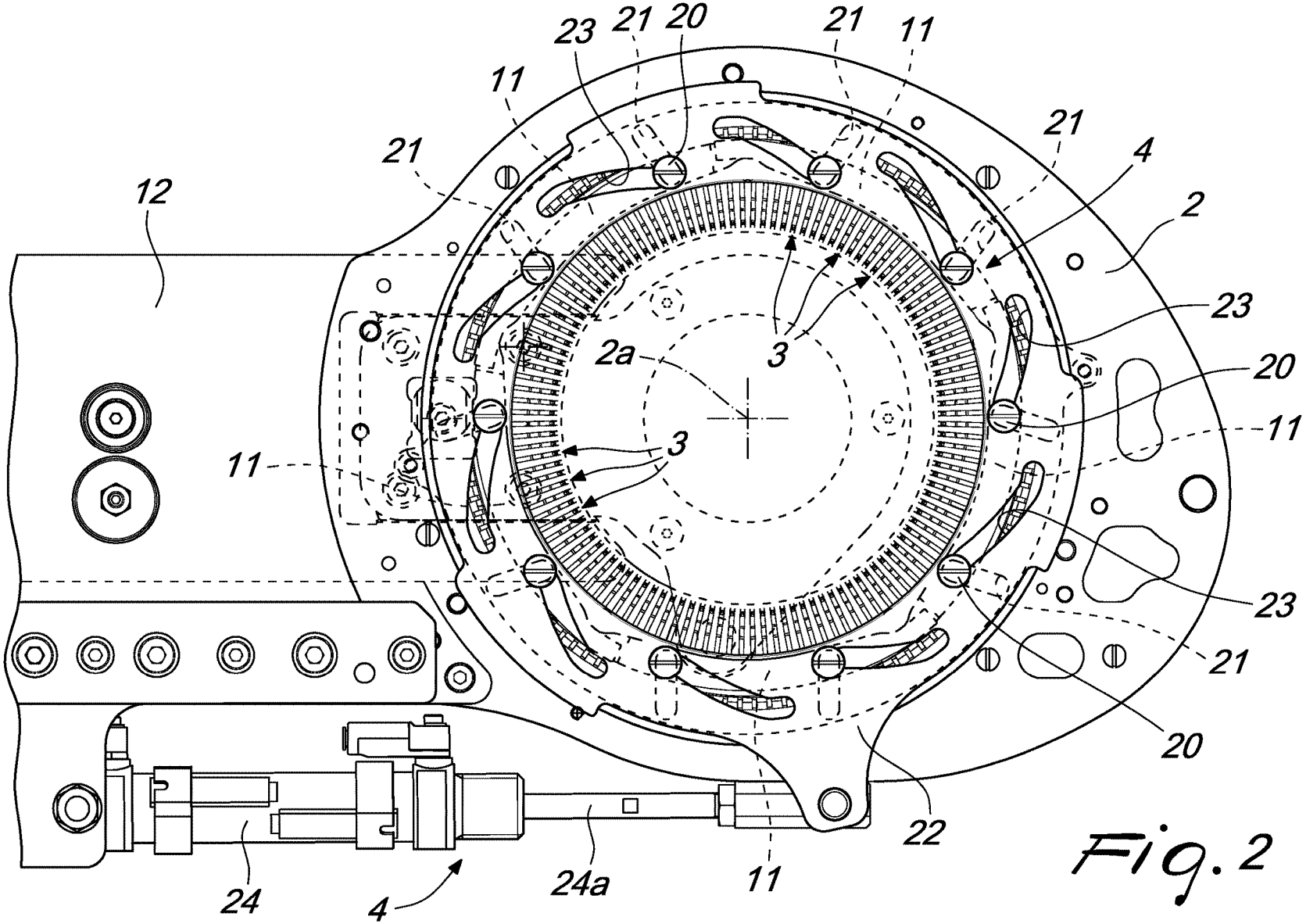
FIG. 2 is a view of the same portion of the pickup device according to the invention, similar to FIG. 1 but with some components shown in phantom lines in order to allow viewing of the underlying components.
Figure 7:
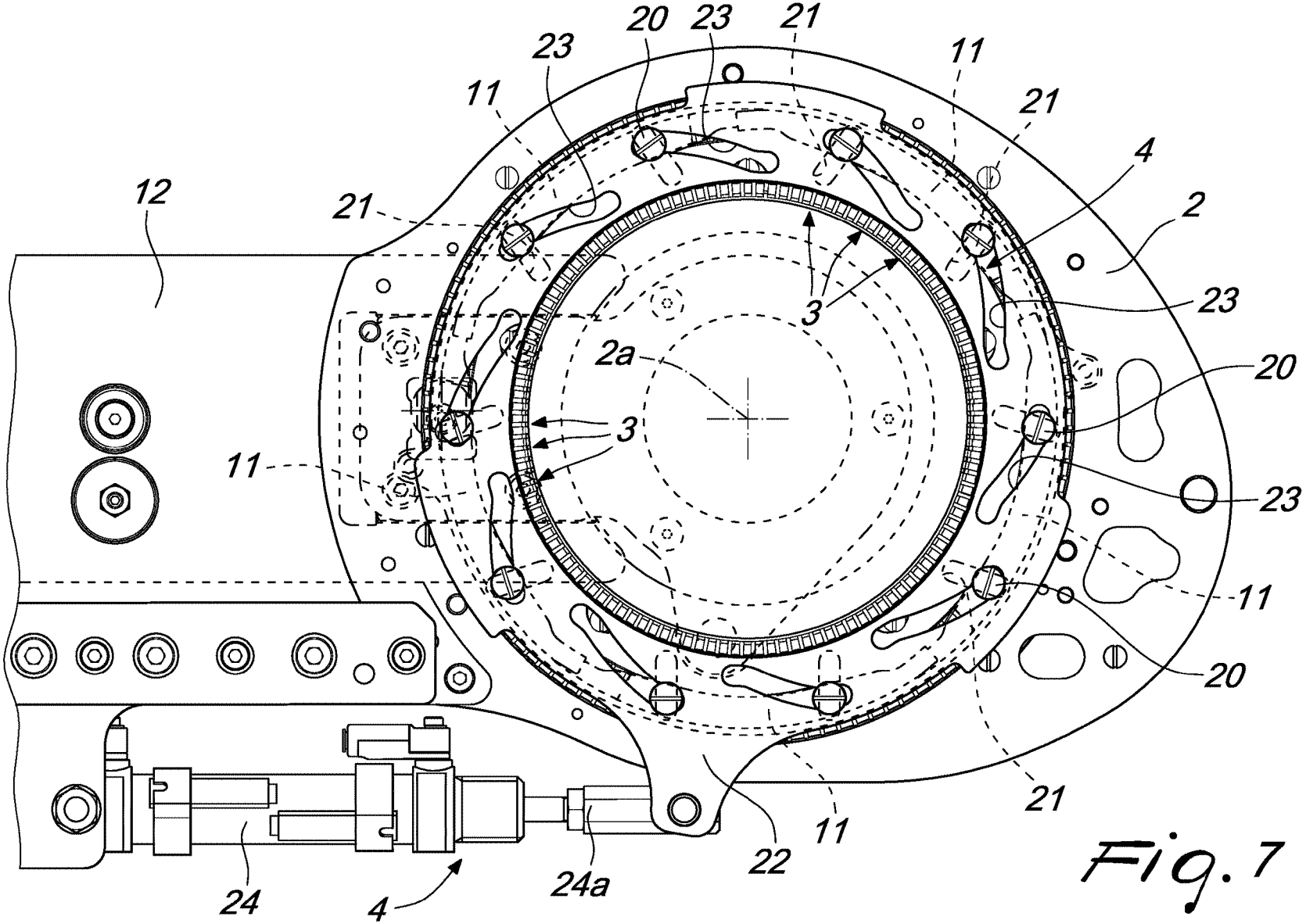
FIG. 7 is a view of the same portion of the pickup device according to the invention, in a manner similar to FIG. 6, but with some components shown in phantom lines in order to allow the viewing of the underlying components.

More particularly, the circumferential seat 9 is formed in an annular body 16 which is integral with the remaining part of the pickup body 2 and forms its inner lateral surface and part of the upper end face. This annular body 16, in FIGS. 2 and 7, is shown in phantom lines in order to allow to view the underlying components.

Advantageously, the ring 8 is made of elastically deformable material so as to cushion the impacts of the tips of the pickup elements 3 when they are moved into the second position, thus avoiding damage to these tips.

Preferably, the ring 8 is constituted by a simple O-ring which is accommodated in the circumferential seat 9.

Each one of the pickup elements 3, in the first position, can engage the needle 44 of the machine 41 that it is made to face in order to pick up the loop of knitting 51 retained on the needle 44.

Conveniently, the end 3*a* of each one of the pickup elements 3 that is directed toward the axis 2*a* has a seat 14, which can engage a region of the stem 44*b* of the needle 44 arranged proximate to the latch 44*d* of the needle 44 on the opposite side with respect to the head 44*c*, and the actuation means 4 comprise elastic means 10, which act on the pickup elements 3 in order to cause their sliding toward the axis 2*a* and radial pushers 11 which act on the pickup elements 3 in order to cause their sliding away from the axis 2*a* in contrast with the action of the elastic means 10.

More particularly, the pickup body 2 is arranged so that its own axis 2*a* is vertical and is fixed to the end of an arm 12, which is arranged horizontally and which, in a manner similar to what is described in international patent application WO2009/112347 A1, can rotate about an actuation axis which is parallel to and spaced from the axis 2*a* and can move on command along the same axis in order to lift and lower the pickup body 2.

Essentially, by means of the rotation of the arm 12 it is possible to actuate the transition of the pickup body 2 from a pickup position, in which it is arranged coaxially to the needles cylinder 42 of the machine 41, to a release position, in which it is arranged at a further work station, which is generally arranged laterally to the machine 41 and is constituted for example by a sewing or looping station, in which the unit adapted to perform further work on the manufacture, and vice versa, is arranged.

The pickup body 2 of the pickup device has a plurality of radial grooves 13, inside each of which a pickup element 3 is accommodated so that it can slide.

Each pickup element 3 has a laminar body which is arranged on a radial plane with respect to the axis 2*a* of the pickup body 2. The end 3*a* of each pickup element 3 that is directed toward the axis 2*a* has the seat 14, which is open both toward the axis 2*a* and parallel to the axis 2*a*, i.e., both above and below. The seat 14, when the pickup body 2 is in the pickup position, can be coupled to the stem 44*b* of a needle 44 which the pickup element 3 faces.

More particularly, the pickup body 2 of the pickup device supports a number of pickup elements 3 that matches the number of the needles 44 of the machine 41 and the pickup elements 3 are angularly spaced around the axis 2*a* of the pickup body 2 in a manner that corresponds to the angular spacing, around the axis 42*a* of the needle cylinder 42, that exists between the needles 44 of the machine 41. Furthermore, the pickup body 2, in a peripheral region, bears a centering pin 15, with a vertical axis, which by means of the lowering of the arm 12, which can be actuated in a per se known manner, can be inserted in a corresponding centering seat provided in the supporting structure of the machine 41 laterally to the needle cylinder 42 and not shown for the sake of simplicity. The coupling between the centering pin 15 and the corresponding centering seat ensures the precise placement of the pickup body 2 and of the pickup elements 3 with respect to the needle cylinder 42 of the machine 41. Adapted control elements, usually provided in modern circular machines for knitting hosiery or the like, allow the precise angular positioning of the needle cylinder 42 about its own axis 42*a* with respect to the supporting structure of the machine 41 and therefore allow to place each needle 44 of the machine 41 in radial alignment with the seat 14 of a corresponding pickup element 3 when required.

The centering pin 15 can be disengaged, from the corresponding centering seat, by means of the lifting of the arm 12, in order to allow the rotation of the arm 12.

Each pickup element 3 rests, with one of its sides, on the bottom of a corresponding radial groove 13 and protrudes from it, in the direction of the axis 2*a*, with its end 3*a* in which the seat 14 is formed. It should be noted that the seat 14 can be delimited laterally by two mutually opposite walls, as in the embodiment shown, but can also be delimited only on one side by a single wall.

Preferably, as mentioned above, the end 3*a* of each pickup element 3 that is directed toward the axis 2*a* of the pickup body 2 is shaped like a hook that is open upward in the illustrated arrangement, and the seat 14 is formed on the back of the hook.

The end 3*b*, which lies opposite the end 3*a*, of each pickup element 3 is heel-shaped, is extended parallel to the axis 2*a* and protrudes upward from the corresponding radial groove 13 of the pickup body 2, so as to form a radial shoulder 17 that is directed toward the axis 2*a*. The elastic means 10 act against the side of said heel that is directed opposite with respect to the axis 2*a* and push the pickup elements 3 toward the axis 2*a*.

The elastic means 10 are constituted preferably by an annular helical spring 30, with an axis that coincides with the axis 2*a*, which is arranged around the pickup elements 3 and acts on the side of the end 3*b* that is heel-shaped and lies opposite the radial shoulder 17.

The radial pushers 11 are arranged in the pickup body 2 and act on command on the radial shoulder 17 so as to cause the sliding of the pickup elements 3 away from the axis 2*a* in contrast with the action of the helical spring 30.

More particularly, an annular fixed plate 18 is fixed to the pickup body 2 and is arranged concentrically to the axis 2*a*. Five radial pushers 11 are arranged inside the pickup body 2, are shaped like annular sectors and face the radial shoulder 17 of the pickup elements 3. Each one of these radial pushers 11 is fixed to a pair of pins 20, which are mutually angularly spaced around the axis 2*a* and are oriented parallel to the axis 2*a*. These pins 20 pass slidingly through first slots 21 which are formed in the fixed plate 18. The pairs of first slots 21 with which the pins 20 of a same radial pusher 11 engage are mutually parallel and are oriented so as to allow the corresponding radial pusher 11 to move radially toward and away from the axis 2*a*. Above the fixed plate 18 there is a movable plate 22, which is also annular and is arranged concentrically to the axis 2*a* and is supported, so that it can rotate about the same axis 2*a*, by the pickup body 2. The movable plate 22 is crossed by second slots 23, one of each pin 20, which are each crossed slidingly by a pin 20. The second slots 23 are inclined with respect to the first slots 21 so that a rotation of the movable plate 22 about the axis 2*a* with respect to the pickup body 2 and the fixed plate 18 causes a movement of the radial pushers 11 toward or away from the axis 2*a*.

The movable plate 22 is connected to the stem 24*a* of the piston of a double-acting fluid-operated cylinder 24 which is mounted on the arm 12 and can be actuated to cause the rotation of the movable plate 22 about the axis 2*a* with respect to the pickup body 2.

Figure 3:
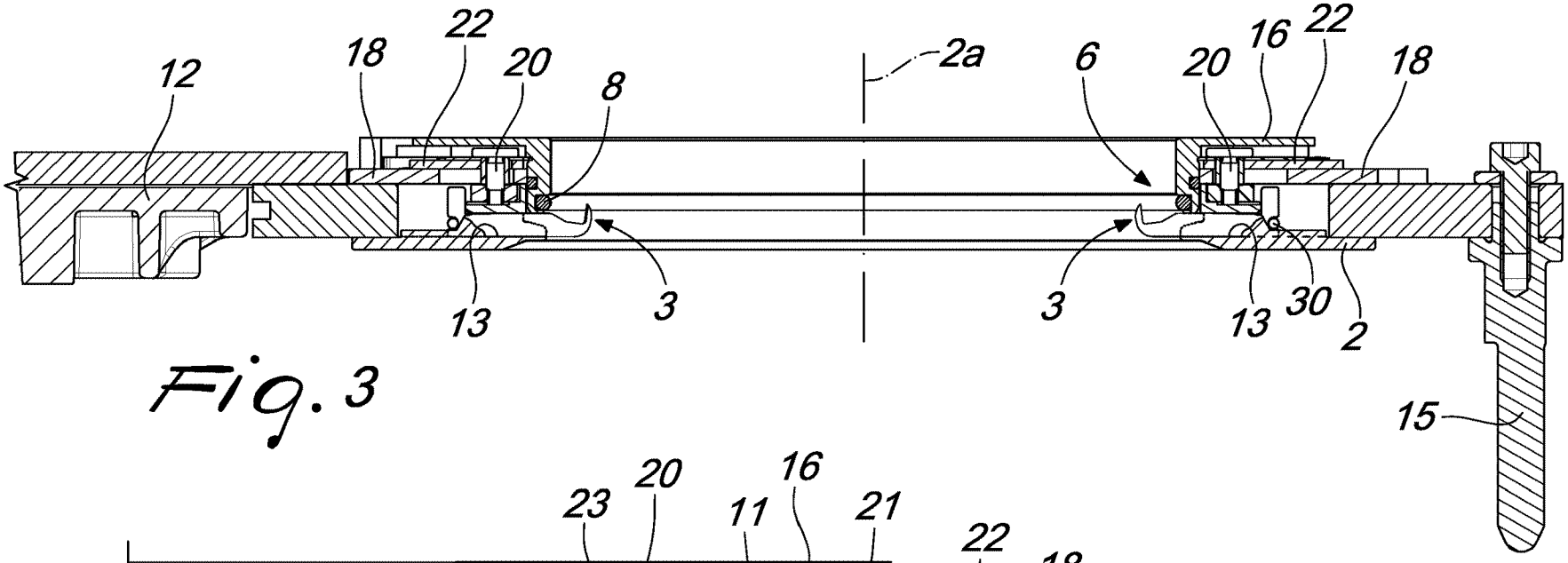
FIG. 3 is a schematic sectional view of FIG. 1, taken along the plane III-III.
Figure 3A:
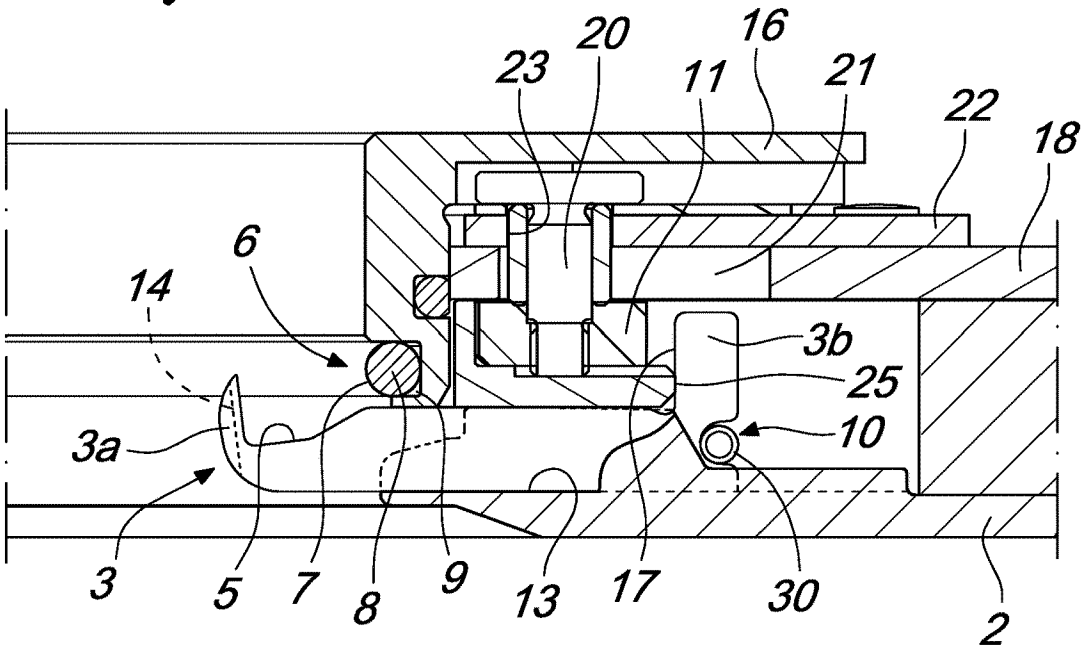
FIG. 3A is an enlarged-scale view of a detail of FIG. 3.
Figure 6:
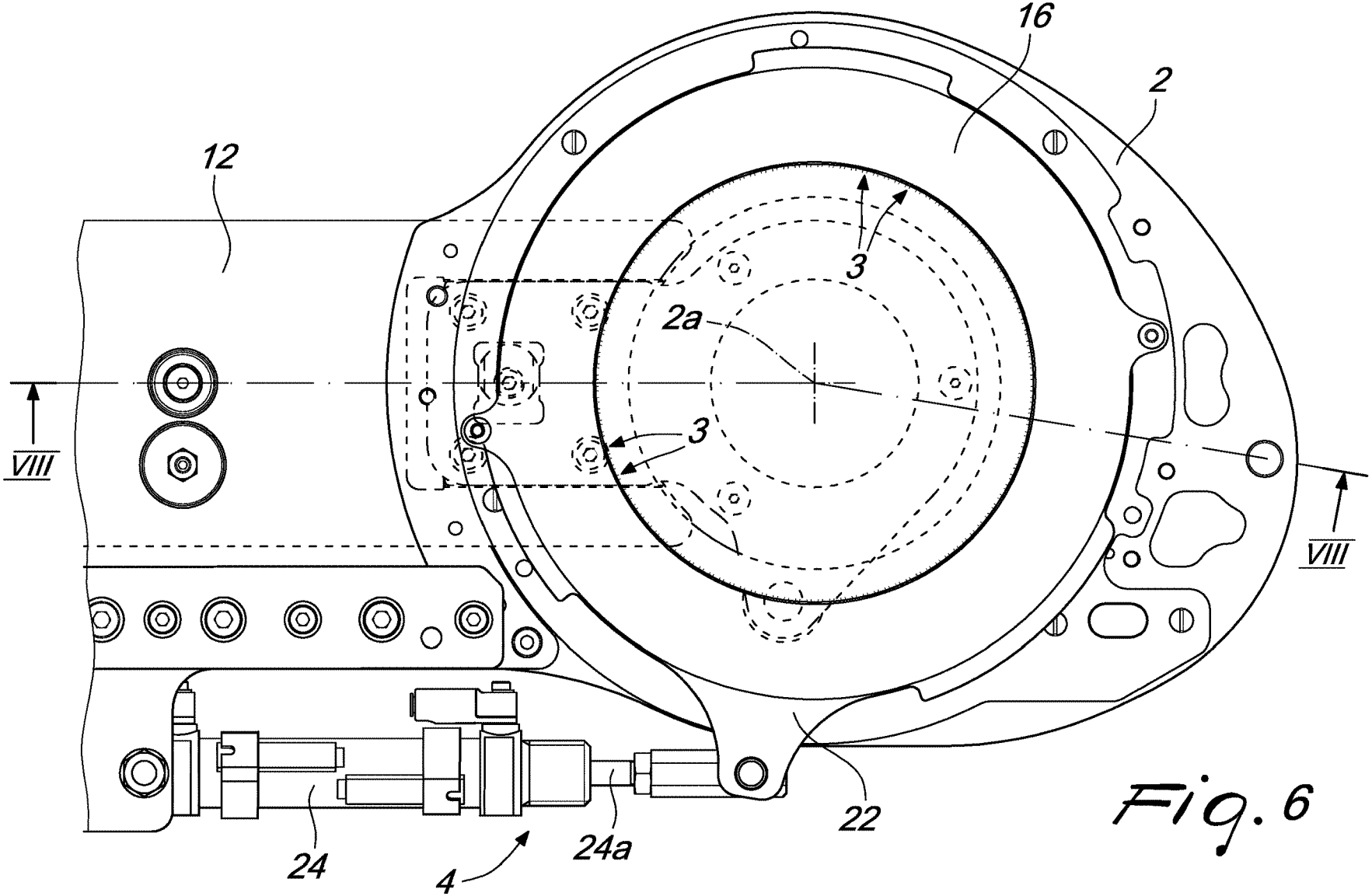
FIG. 6 is a schematic view of the same portion of the pickup device according to the invention in a top plan view and with the pickup elements in the second position, with some elements omitted for the sake of simplicity and for greater clarity.
Figure 8:
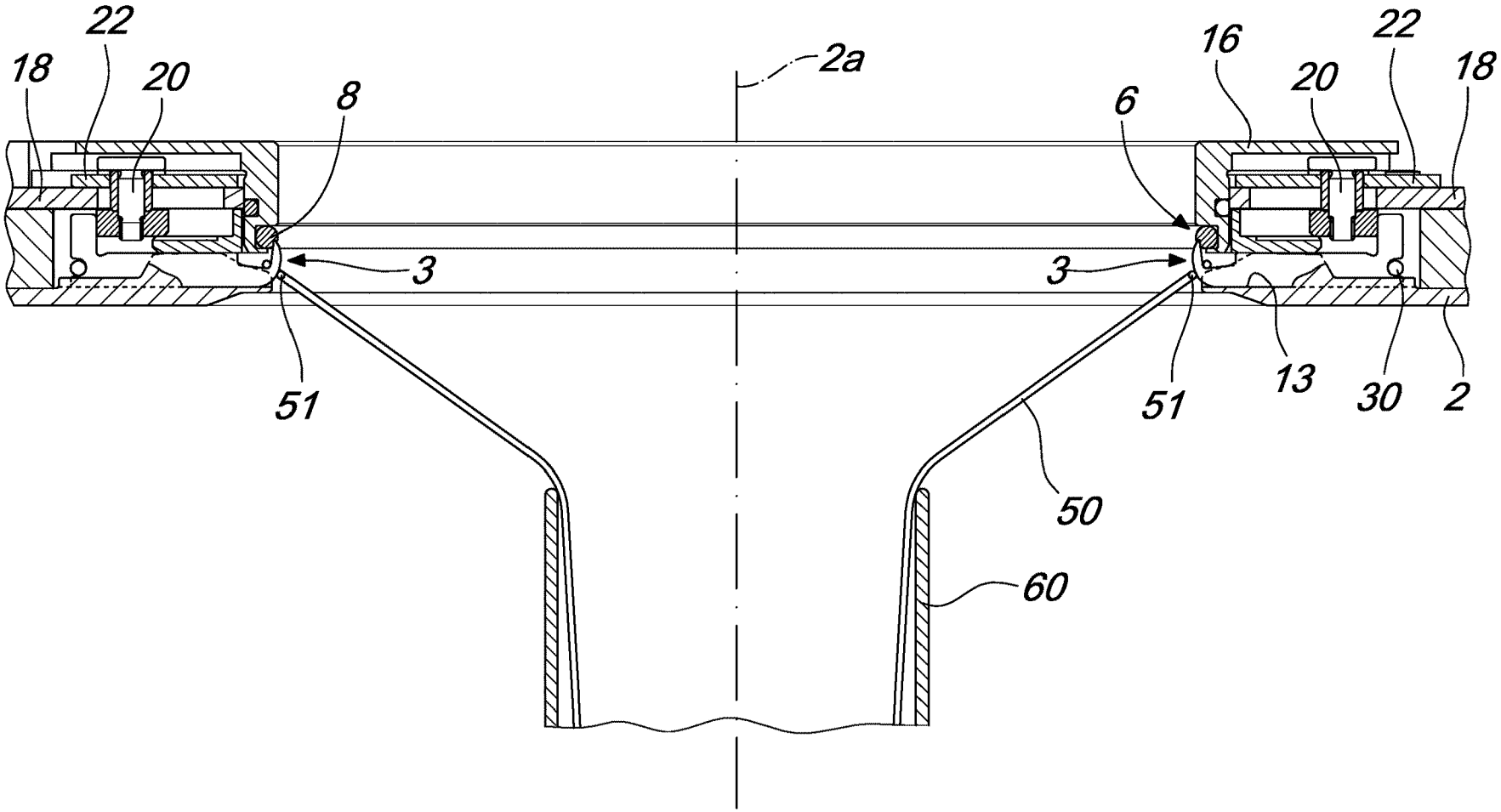
FIG. 8 is a schematic sectional view of FIG. 6, taken along plane VIII-VIII.
Figure 8A:
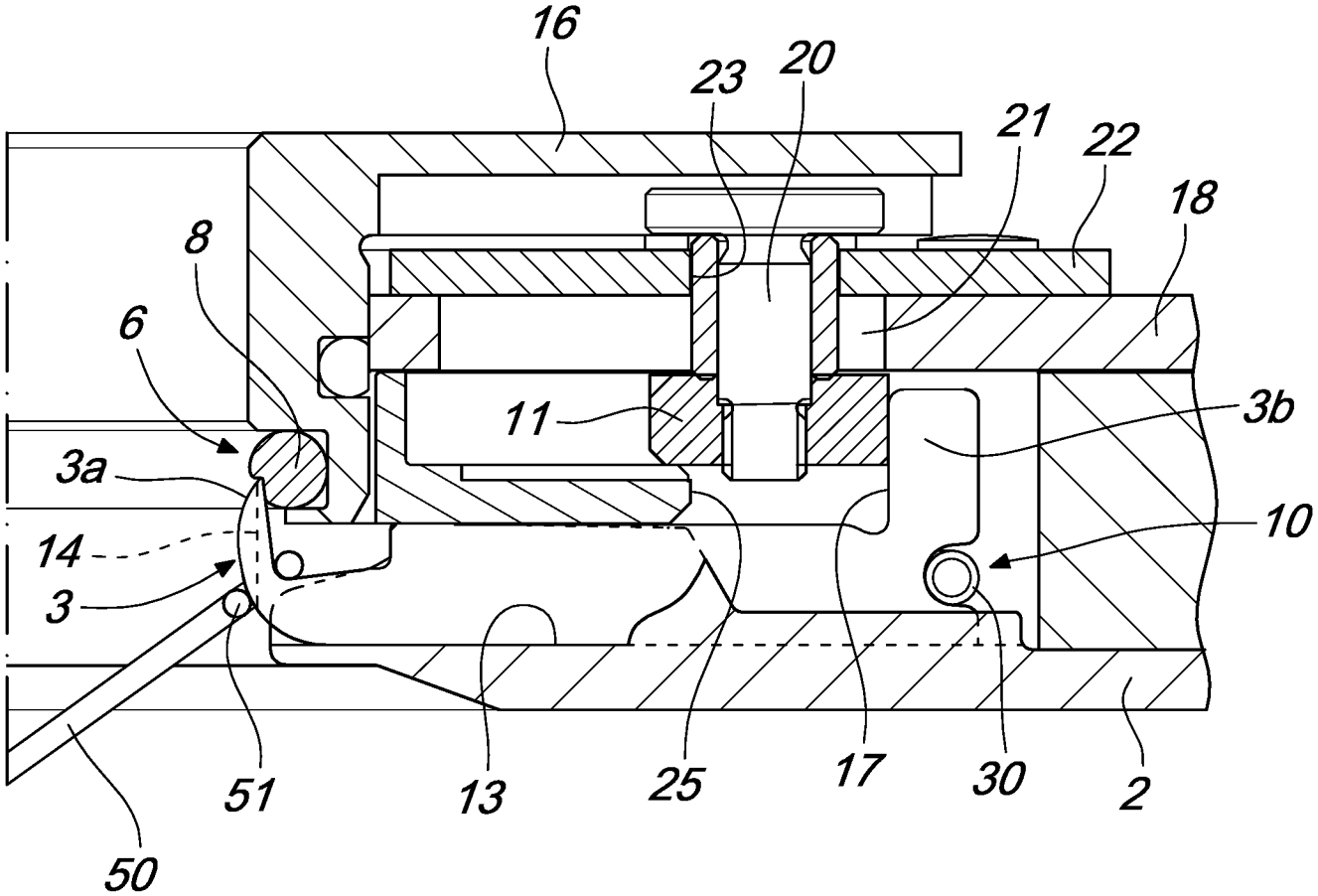
FIG. 8A is an enlarged-scale view of a detail of FIG. 8.

In practice, the actuation of the fluid-operated cylinder 24 causes the rotation of the movable plate 22 about the axis 2*a* with respect to the pickup body 2 in one direction, spacing the radial pushers 11 and therefore the pickup elements 3 from the axis 2*a* in contrast with the action of the helical spring 30, as shown in particular in FIGS. 6, 7 and 8, or in the opposite direction by actuating the approach of the radial pushers 11 to the axis 2*a*, allowing the movement of the pickup elements 3 toward the axis 2*a* by virtue of the action of the helical spring 30, as shown in particular in FIGS. 1, 2 and 3. The stroke of the pickup elements 3 toward the axis 2*a* is delimited by a shoulder 25 that lies opposite the radial shoulder 17 and is formed inside the pickup body 2 or by the radial pushers 11.

It should be noted that each pickup element 3 engages the stem 44*b* of the corresponding needle 44 by virtue of the action of the helical spring 30. As a consequence of this fact, a sort of adaptation of the stroke of each pickup element 3 in the direction of the axis 2*a* to the actual radial position of the corresponding needle 44 is achieved. In practice, the particular actuation of the pickup elements 3 renders the coupling of each pickup element 3 to the corresponding needle 44 less critical, since it can obviate imprecise radial placements of the needles 44, ensuring in any case a precise coupling. Furthermore, the particular actuation of the pickup elements 3, in addition to allowing excellent containment of the axial space occupation of the pickup body 2 as a whole, also allows one to use the same pickup device with machines that have the same number of needles 44 but are arranged according to cylindrical surfaces that have slightly different diameters.

The pickup device also comprises a presser element 26, which has a circular plan shape with a comb-like perimetric profile with a plurality of teeth 27 arranged around the axis 26*a*, which is oriented vertically, of the presser element 26.

The presser element 26 is connected to an end of a corresponding arm 28 which, in the illustrated embodiment, is arranged above the arm 12. The arm 28, in a manner similar to the arm 12 that supports the pickup body 2, can rotate about an axis that is parallel and spaced laterally to the axis 26*a* and can move on command along said axis, which can coincide with the axis about which the arm 12 that supports the pickup body 2 can rotate.

In practice, the pickup device according to the invention can be provided and actuated substantially like the pickup device shown in international patent application WO2009/112347 A1 with the addition of the safety means 6.

For the sake of completeness in description, it should be noted that in the sectional views of the accompanying drawings only two pickup elements 3 have been shown for the sake of simplicity and for greater clarity.

The operation of the pickup device according to the invention is as follows.

The manufacture 50 is produced on the circular knitting machine for hosiery or the like by beginning its production from one axial end and ending it at the opposite axial end.

The last formed row of knitting is held on the needles 44 in the head 44*c* of the needles 44 above the latch 44*d*, optionally utilizing the lifting possibility of the suction tube 45 arranged inside the needle cylinder 42.

With the manufacture 50 thus retained by the needles 44, as explained in WO2009/112347 A1, the pickup body 2 and the presser element 26 are arranged above and coaxially to the needle cylinder 42 and the pickup body 2, with the pickup elements 3 in the second position or in a position that is intermediate between the first position and the second position, is then lowered until the hook-shaped tip of the ends 3*a* is brought to a level that is lower than the level of the ends of the open latches 44*d* of the needles 44.

The lowering of the pickup body 2 causes the engagement of the centering pin 15 with the corresponding seat provided in the knitting machine 41 for hosiery or the like.

Figure 4A:
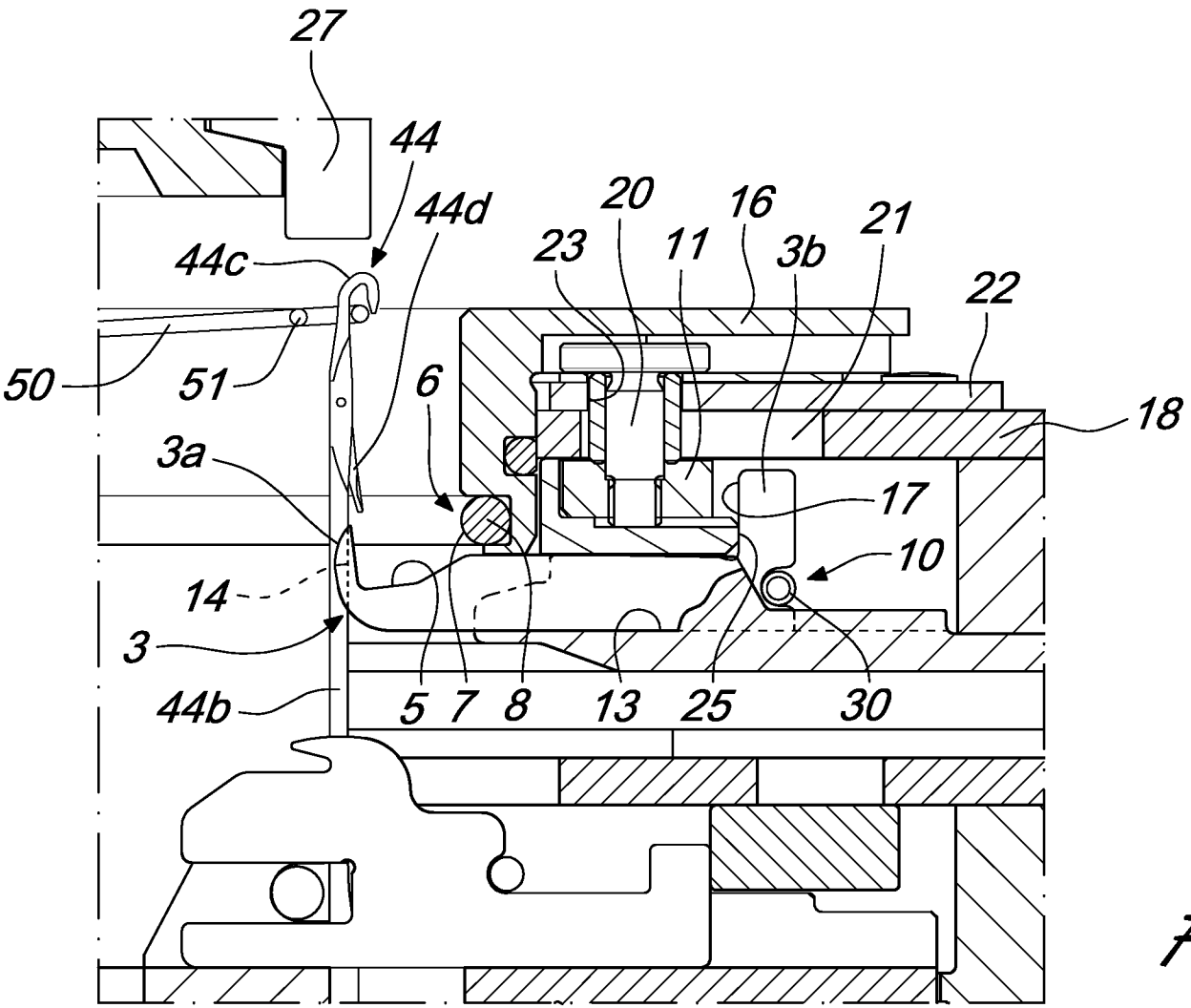
FIG. 4A is an enlarged-scale view of detail of FIG. 4.

At this point, the fluid-operated cylinder 24 is actuated and, by rotating the movable plate 22, causes the movement of the radial pushers 11 toward the axis 2*a*, thus allowing the pickup elements 3 to move toward the axis 2*a* by virtue of the action of the thrust applied by the helical spring 30. The end 3*a* of each pickup element 3 that is directed toward the axis 2*a* rests with the seat 14 against the stem 44*b* of the corresponding needle 44 directly below the latch 44*d* of the same needle 44, as shown in FIGS. 4, 4A.

After the engagement of the pickup elements 3 against the stem 44*b* of the corresponding needles 44, the pickup body 2 is raised slightly, so that the end 3*a* of each pickup element 3 engages, by means of the seat 14, the stem 44*b* of the needle 44 between the free end of the open latch 44*d* of a needle 44 and the stem 44*b* of the needle 44.

Figure 5A:
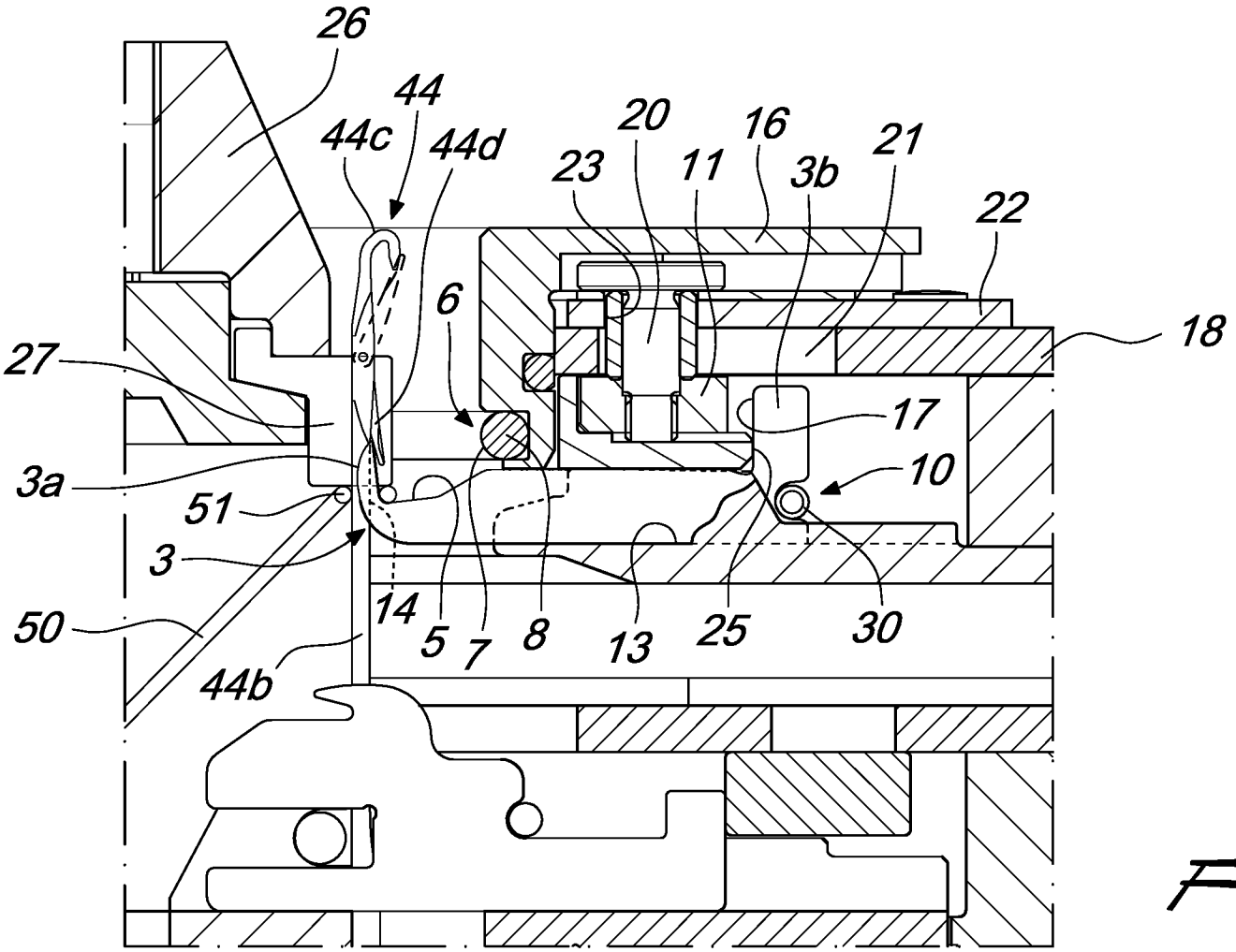
FIG. 5A is an enlarged-scale view of a detail of FIG. 5.

The suction tube 45 is then lowered and the transition of the presser element 26 to the lowered position, in which it penetrates with the teeth 27 of its perimetric profile between the needles 44 and between the pickup elements 3, is caused. As a consequence of this axial movement of the presser element 26, the loops of knitting 51 are pushed into the hook-shaped end 3*a* of the pickup elements 3 below the latches 44*d* of the needles 44, as shown in FIGS. 5, 5A.

The pickup body 2 of the pickup device is then raised along its own axis 2*a* with respect to the needle cylinder 42 together with the presser element 26. This lifting, by virtue of the sliding toward the head 44*d* of the corresponding needle 44 of the pickup elements 3, which previously were arranged so that their end 3*a* was below the open latch 44*d* of the corresponding needle 44, causes the closure of the latches 44*d* on the heads 44*c* of the needles 44 and the disengagement of the loops of knitting 51 from the needles 44.

In this step the suction tube 45 is lifted again to assist the upward motion of the manufacture 50 and to protect the manufacture 50 from contact with the parts of the machine 41 that are arranged around the needles 44 in the step that follows.

The arms 12 and 28 are then rotated so as to transfer the pickup body 2 of the pickup device and the presser element 26 from the machine 41 to the station for further work.

Optionally, in this position, the manufacture 50 can be aspirated pneumatically in a reversing tube 60 which is arranged below and coaxially to the pickup body 2.

In the pickup device according to the invention, after the manufacture 50 has been disengaged from the needles 44 of the machine 41, it is possible to cause the transition of the pickup elements 3 from the first position to the second position by means of the actuation of the fluid-operated cylinder 24.

In passing to the second position, as shown in FIGS. 6 to 8, the pickup elements 3 engage, with the tip of their hook-shaped end 3*a*, against the ring 8, closing the compartment 5 in which the loop of knitting 51 picked up from the corresponding needle 44 is contained. In this manner, one achieve assurance that the loops of knitting 51 do not disengage accidentally from the pickup elements 3 neither during transfer of the manufacture 50 from the machine 41 to the station for subsequent work nor during subsequent operations, for example during the reversing of the manufacture 50 performed by making the reversing tube 60 pass through the manufacture 50 from the bottom upward.

In practice it has been found that the pick-up device according to the invention achieves fully the intended aim, since it ensures high safety against the accidental disengagement of the loops of knitting of the pickup elements.

Furthermore, the pickup device preserves all the advantages of a pickup device provided according to WO2009/112347 A1.

The pickup device thus conceived is susceptible of numerous modifications and variations, all of which are within the scope of the appended claims; all the details may further be replaced with other technically equivalent elements.

In practice, the materials used, as well as the dimensions, may be any according to the requirements and the state of the art.

The disclosures in Italian Patent Application No. 102016000072994 (UA2016A005144) from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A pickup device for picking up a knitted tubular manufacture from a circular knitting machine for hosiery and for transferring it to a unit adapted to perform additional operations on the manufacture, comprising an annular pickup body that supports a plurality of pickup elements, which are arranged radially around an axis of said annular pickup body and can slide with respect to said annular pickup body along radial directions, said annular pickup body being arrangeable coaxially around a needle cylinder of the circular knitting machine for hosiery, with each one of said plurality of pickup elements laterally facing a needle of the machine; actuation means being provided which act on said plurality of pickup elements for their movement along said radial directions at least from a first position, in which said plurality of pickup elements are closer to the axis of said annular pickup body, to a second position, in which each one of said plurality of pickup elements are spaced further from the axis of said annular pickup body with respect to said first position, and vice versa; an end of each one of said plurality of pickup elements that is directed toward the axis of said annular pickup body being hook-shaped and forming a compartment that is adapted to receive at least one loop of knitting, further comprising safety means which are associated with said annular pickup body and can be engaged by said end of each one of said plurality of pickup elements in their transition from said first position to said second position for a closure of said compartment, wherein the end of each one of said plurality of pickup elements that is directed toward the axis of said annular pickup body is hook-shaped and has its tip oriented substantially parallel to the axis of the annular pickup body, said safety means comprising a circumferential abutment that is extended around the axis of said annular pickup body; said plurality of pickup elements, in said second position, engaging the tip of their hook-shaped end against said circumferential abutment; wherein said circumferential abutment is formed by a ring that is accommodated in a circumferential seat that is formed coaxially on the internal lateral surface of said annular pickup body and is open toward the axis of said annular pickup body.

2. The device according to claim 1, wherein said ring is made of elastically deformable material.

3. The device according to claim 1, wherein said ring is constituted by an O-ring.

4. The device according to claim 1, wherein each one of said plurality of pickup elements, in said first position, can engage the needle of the machine which it is made to face, in order to pick up one of the at least one loop of knitting retained on said needle, the end of each one of said plurality of pickup elements that is directed toward the axis of said annular pickup body having a seat that can engage a region of a stem of the needle that is located proximate to a latch of the needle on an opposite side with respect to a head of the needle; said actuation means comprise elastic means that act on said plurality of pickup elements for their sliding toward the axis of said annular pickup body and radial pushers which act on said plurality of pickup elements for their sliding away from the axis of said annular pickup body in contrast with the act of said elastic means on said pickup elements.

5. The device according to claim 1, wherein said annular pickup body is oriented so that its axis is vertical and is mounted on an arm that can rotate on command, with respect to a supporting structure, about a vertical actuation axis, which is spaced from the axis of said annular pickup body, for a transition of said annular pickup body from a pickup position, in which it is arranged coaxially to the needle cylinder of the machine, to a release position, in which it is arranged at a station for additional processing, or vice versa.

6. The device according to claim 4, wherein said annular pickup body has a plurality of radial grooves, each of which accommodates slidingly a pickup element, said annular pickup body supporting said radial pushers which act on command on said pickup elements for their sliding away from the axis of said annular pickup body in contrast with the action of said elastic means; means being provided for delimiting a stroke of said plurality of pickup elements toward the axis of said annular pickup body.

7. The device according to claim 4, wherein said seat is formed on a back of a hook that constitutes the end of each one of said plurality of plurality of pickup elements that is directed toward the axis of said annular pickup body.

8. The device according to claim 4, wherein the end of each one of said plurality of pickup elements that is directed toward the axis of said annular pickup body can engage, by means of said seat, the stem of the needle between a free end of the latch of a needle and the stem of said needle.

9. The device according to claim 4, wherein an end of each one of said plurality of pickup elements that is opposite with respect to the end that is directed toward the axis of said annular pickup body is shaped like a heel, which is extended parallel to the axis of said annular pickup body and protrudes upward from a corresponding radial groove; said end shaped like a heel forming a radial shoulder that is directed toward the axis of said annular pickup body; said radial pushers acting on said radial shoulder in an opposite direction with respect to the axis of said annular pickup body and said elastic means acting on the side of said heel-shaped end of each one of the plurality of pickup elements that is opposite with respect to said radial shoulder.

10. The device according to claim 4, wherein said elastic means are constituted by a helical spring that has an annular shape and is arranged in said annular pickup body around said plurality of pickup elements.

11. The device according to claim 6, wherein each one of said radial pushers is contoured like an annular sector and is supported slidingly by said annular pickup body along a corresponding direction that is oriented radially with respect to said annular pickup body; each one of said radial pushers being integral with at least two pins that are oriented axially with respect to said annular pickup body and are angularly mutually spaced around the axis of said annular pickup body; said at least two pins engaging slidingly with corresponding first slots, which are parallel to each other and are oriented in a manner that allows a radial movement of a corresponding radial pusher with respect to said annular pickup body and are formed in an annular fixed plate that is fixed coaxially to said annular pickup body; said at least two pins further engaging second slots formed in a movable plate, which is annular and is arranged coaxially to said annular pickup body; said second slots being inclined with respect to said first slots and said movable plate being able to rotate about its own axis with respect to said annular pickup body in order to cause the sliding of said at least two pins along said first slots.

12. The device according to claim 11, further comprising a fluid-operated cylinder that is mounted on said arm and is connected by means of a stem of a piston thereof to said movable plate; said fluid-operated cylinder being actuatable in order to actuate a rotation of said movable plate about its own axis with respect to said annular pickup body.

* * * * *